US008146749B2

(12) United States Patent
Moosmann

(10) Patent No.: US 8,146,749 B2
(45) Date of Patent: Apr. 3, 2012

(54) PLAN SIFTER AND DRIVE FOR A PLAN SIFTER

(75) Inventor: Jürgen Moosmann, Berg (DE)

(73) Assignee: Bühler AG, Uzwil (CH)

( * ) Notice: Subject to any disclaimer, the term of this patent is extended or adjusted under 35 U.S.C. 154(b) by 34 days.

(21) Appl. No.: 12/523,422

(22) PCT Filed: Nov. 22, 2007

(86) PCT No.: PCT/CH2007/000584

§ 371 (c)(1),
(2), (4) Date: Jul. 16, 2009

(87) PCT Pub. No.: WO2008/089589

PCT Pub. Date: Jul. 31, 2008

(65) Prior Publication Data

US 2010/0006480 A1 Jan. 14, 2010

(30) Foreign Application Priority Data

Jan. 22, 2007 (DE) ..... 10 2007 004 150

(51) Int. Cl.
*B07B 1/42* (2006.01)

(52) U.S. Cl. ..... 209/365.1; 209/315; 209/367; 209/370; 209/373

(58) Field of Classification Search ..... 209/315, 209/317, 357, 364, 365.1, 365.2, 366.5, 367, 209/370, 373

See application file for complete search history.

(56) References Cited

U.S. PATENT DOCUMENTS

| | | | | |
|---|---|---|---|---|
| 66,783 | A * | 7/1867 | Blossom et al. | 209/292 |
| 1,207,847 | A * | 12/1916 | Brantingham | 74/87 |
| 1,327,636 | A * | 1/1920 | Snyder et al. | 209/366.5 |
| 1,368,047 | A * | 2/1921 | Neal | 209/317 |
| 2,238,454 | A * | 4/1941 | Steele et al. | 209/235 |
| 2,511,885 | A * | 6/1950 | Thompson | 209/332 |
| 2,634,617 | A * | 4/1953 | Dryg | 74/87 |
| 2,807,367 | A * | 9/1957 | Symons | 209/301 |
| 3,815,741 | A | 6/1974 | Keller | |
| 4,370,226 | A | 1/1983 | Fullalove | |
| 5,518,108 | A | 5/1996 | Spurlin | |
| 6,260,710 | B1 | 7/2001 | Deillon et al. | |
| 2004/0040895 | A1 * | 3/2004 | Fiorini | 209/359 |

FOREIGN PATENT DOCUMENTS

| | | |
|---|---|---|
| DE | 2256307 | 7/1973 |
| DE | 19704576 | 8/1998 |
| DE | 19746678 | 5/1999 |
| EP | 1090691 | 4/2001 |
| WO | 87/05542 | 9/1987 |
| WO | 98/07529 | 2/1998 |

* cited by examiner

*Primary Examiner* — Joseph C Rodriguez
(74) *Attorney, Agent, or Firm* — Shoemaker and Mattare

(57) ABSTRACT

A plan sifter for sifting or sieving, flour-like or granular products, includes at least one compartment. Each sifting compartment has a dedicated drive, so that the base surface available can be better utilized, and the sifting capacity can be better adjusted to actual needs.

4 Claims, 1 Drawing Sheet

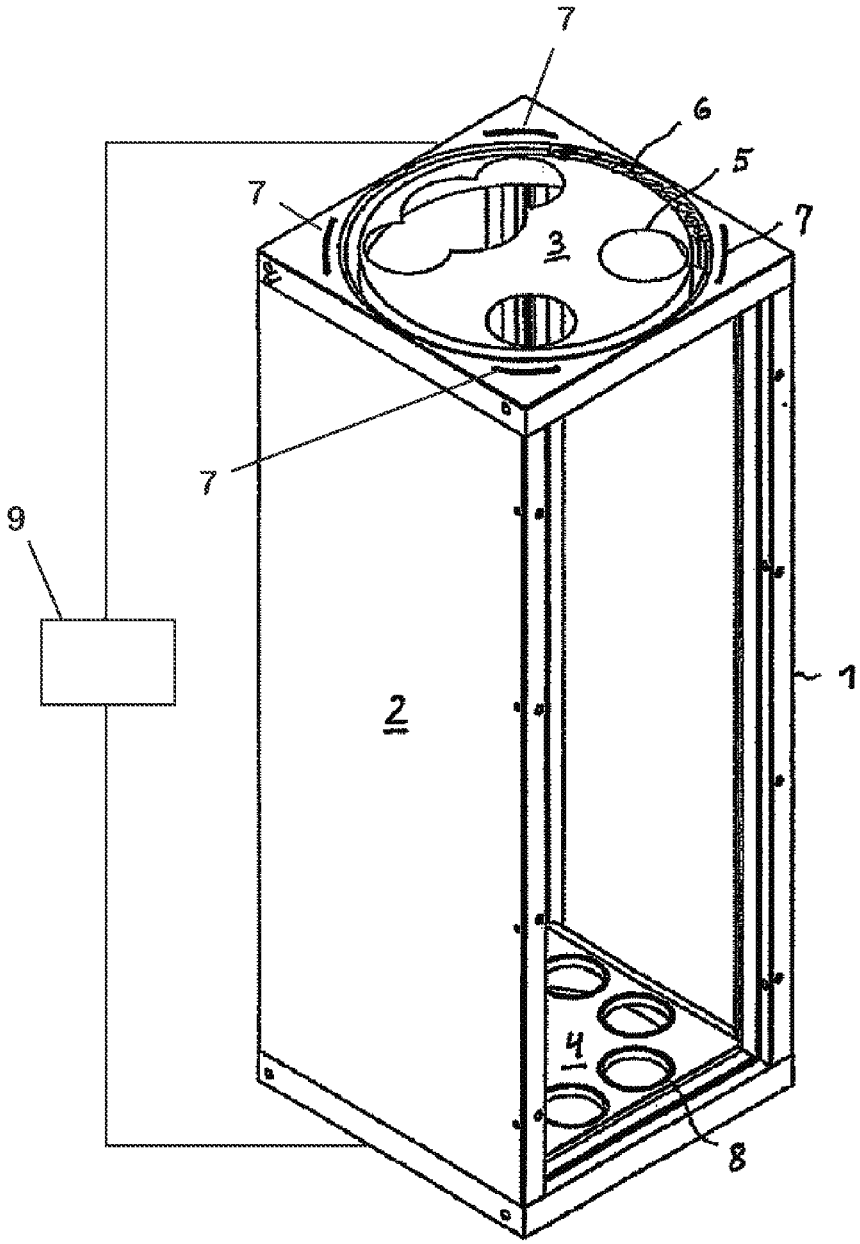
7
6
5
7
7
3
7
9
1
2
4
8

PLAN SIFTER AND DRIVE FOR A PLAN SIFTER

BACKGROUND OF THE INVENTION

The invention relates to a plan sifter for the sifting or sieving of mealy or granular products, which consists of at least one compartment. The invention also relates particularly to a drive for a plan sifter.

Plan sifters for the sifting of mealy or granular products in mills, in particular in corn mills, are in very widespread use. They have a closable housing with at least one stack of sieves which are arranged one above the other and the covering of which has a mesh width decreasing from the top downwards, so that products of the same particle size ranges can be brought together. For executing the sieving movement, the plan sifter is set in uniformly oscillating motion by means of an unbalance drive.

When a plurality of sieving compartments are arranged in an even number, arrangement may take place in two rows, the drive being arranged between the two rows, as disclosed, for example, in DE 2256307. Furthermore, for example, arrangements of two blocks of four screening compartments with a drive unit lying between them are known (EP-A-1396289).

In order to utilize the space in the drive compartment more effectively, it has also been proposed to arrange sieving compartments at the ends thereof and thus form a closed ring arrangement of sieving compartments (DE 197 46 678). Disadvantages are both the poor access to the drive and unequal motion conditions.

Moreover, in all the variants, only even-numbered multiples of sifting compartments can be arranged to form a plan sifter.

SUMMARY OF THE INVENTION

The object on which the invention is based is to develop a plan sifter for the sifting or sieving of mealy or granular products, which makes it possible to have both an even number and an odd number of sieving compartments in the plan sifter.

The object is achieved by the plan sifter described below.

An important feature is that each sieving compartment has a dedicated drive. Hence, the available base area can be utilized more effectively and the sifting capacity can be adapted better to actual requirements. Plan sifters with an odd number of sieving compartments can therefore be implemented. Further embodiments are disclosed below.

Preferably, the drives have no or only a few mechanically moved parts, and they are synchronizable (in the case of more than one drive or sieving compartment).

A further object is to develop a drive for a plan sifter having at least one sieving compartment.

The drive is, for example, a reluctance motor with ring-shaped toothed disks and outer coils, in each case an identical drive being arranged on the top and on the bottom of a sieving compartment. Further drive principles are, inter alia, asynchronous motors and synchronous motors.

The coils are preferably arranged in the region of the corners of the top and bottom near the toothed disks.

Any desired inlets and outlets for the product to be sifted can be arranged, free of centrifugal force, within the ring-shaped arrangement of the toothed disks.

All the drives must operate synchronously, and, on starting, all masses have to be in the same position.

The same components are used for all the sieving compartments, thus making manufacture and logistics markedly simpler.

BRIEF DESCRIPTION OF THE DRAWING

The invention is described in more detail below in an exemplary embodiment with reference to a drawing. The drawing shows an open sieving compartment of a plan sifter without a door and without a suspension.

DETAILED DESCRIPTION OF THE INVENTION

The sieving compartment 1 consists in the usual way of side walls 2, a top 3 having inlet orifices 5 for the product to be sifted and a bottom 4 having outlet orifices 8 for the sifted product. Sieves, not illustrated, are arranged on the inside of the sieving compartment 1 in the usual way to form a sieving stack.

Toothed disks 6 are arranged in segments in the form of a ring on the top 3 and on the bottom 4 on the outside in the same way, all the inlet and outlet orifices 5, 8 being arranged inside the ring of toothed disks 6.

Coils 7 are assigned to the toothed disks 6 in the region of the corners of the top 3 and bottom 4 such that a reluctance motor is formed, such as is disclosed, for example, in DE-A-19704576.

The two drives are operated synchronously by means of a control unit 9. On starting, the masses of the toothed disks must be in the same position in both drives in order to achieve rapid starting. This applies similarly to all the sieving compartments 1 of the plan sifter, since each sieving compartment 1 is provided with the abovementioned drives.

The plan sifter formed from at least one sieving compartment 1 is suspended, freely oscillating, in the usual way on flexible bars on the ceiling of a sieve tray.

Depending on the available space or other criteria, each sieving compartment 1 may be suspended individually and/or be arranged in any desired number to form conventional plan sifters.

The invention claimed is:

1. A plan sifter for sifting or sieving mealy or granular products, comprising at least one sieving compartment with sidewalls and a top and also a bottom, said top and bottom both having orifices through which the product can pass, at least two drives for oscillating the sieving compartment, said sieving compartment being set in uniformly oscillating motion by said drives, the plan sifter being arranged so as to oscillate freely, wherein one of said drives is arranged in each sieving compartment on the top and another of said drives is arranged in said compartment on the bottom, wherein each of said drives has the form of a ring, and wherein the orifices for the product at the top and at the bottom of the sieving compartment are disposed within the respective rings.

2. The plan sifter as claimed in claim 1, wherein all the drives are controlled and operated synchronously.

3. The plan sifter as claimed in claim 1, wherein the plan sifter comprises a control unit for controlling said drives.

4. The plan sifter as claimed in claim 3, wherein the control unit synchronizes movement of said drives.

* * * * *